US005660498A

United States Patent [19]

Freeman

[11] Patent Number: 5,660,498

[45] Date of Patent: Aug. 26, 1997

[54] PATCHING SYSTEM AND METHOD FOR REPAIRING ROADWAYS

[76] Inventor: Roger Freeman, 10815 Mackey-G, Overland Park, Kans. 66210

[21] Appl. No.: 586,577

[22] Filed: Jan. 16, 1996

[51] Int. Cl.[6] ..... E01C 7/32

[52] U.S. Cl. ..... 404/17; 404/73; 404/82; 428/63; 428/489

[58] Field of Search ..... 404/72, 73, 75, 404/82; 428/40.3, 63, 489

[56] References Cited

U.S. PATENT DOCUMENTS

| | | | |
|---|---|---|---|
| 3,625,119 | 12/1971 | Gagle et al. . | |
| 3,741,856 | 6/1973 | Hurst | 161/88 |
| 3,900,102 | 8/1975 | Hurst | 206/411 |
| 3,900,687 | 8/1975 | Meader, Jr. et al. . | |
| 3,915,582 | 10/1975 | Clarke . | |
| 3,930,100 | 12/1975 | McDonald . | |
| 4,113,401 | 9/1978 | McDonald . | |
| 4,172,830 | 10/1979 | Rosenberg et al. | 428/245 |
| 4,334,798 | 6/1982 | Milne . | |
| 4,442,148 | 4/1984 | Stierli | 428/40 |
| 4,547,399 | 10/1985 | Fujihara et al. | 427/138 |
| 4,556,338 | 12/1985 | Fahey . | |
| 4,684,288 | 8/1987 | Chapa . | |
| 5,028,487 | 7/1991 | Kindt et al. | 428/489 |
| 5,183,353 | 2/1993 | Buckelew . | |
| 5,464,303 | 11/1995 | Wells | 404/75 |

FOREIGN PATENT DOCUMENTS 2207940 2/1989 United Kingdom .

OTHER PUBLICATIONS

Vance Bros Inc., Material Safety Data Sheet, AC–10, VAC 10, 85/100; May 18, 1993.

Vance Bros Inc.,Material Safety Data Sheet, AC–20, VAC 20, 60/70; May 19, 1993.

Akzo Chemicals Inc., Material Safety Data Sheet, Redicote (R) 82–S Proprietary Asphalt Antistripping Compound; Aug. 10, 1988.

Shell Material Safety Data Sheet, Shellflex (R) 4132; Feb. 23, 1993.

Shell Material Safety Data Sheet, Kraton(R) D1118 Thermoplastic Rubber; Jun. 25, 1993.

Shell Material Safety Data Sheet, Kraton (R) D1112P Thermoplastic Rubber; Jul. 17, 1992.

Hercules, Material Safety Data Sheet, Pentalyn (R) H Synthetic Resin; Jun. 16, 1995.

*Primary Examiner*—James Lisehora

*Attorney, Agent, or Firm*—Hovey, Williams, Timmons & Collins

[57] ABSTRACT

An improved roadway patching system and method is provided for repairing potholes (12) or other damaged roadway areas. The patching system of the invention includes a lower asphaltic liner (18) which is adapted for placement within a pothole (12) or the like in closely conforming and adhering relationship with the inner contour (14) thereof in order to present a substantially water-impervious barrier. A fill (34) is then placed within the pothole (12) atop the liner (18). The patch is completed by provision of an asphaltic, water-impervious, substantially non-stretch top mat (20) which is applied over the fill (34) and engaging and adhering to the liner (18) and adjacent portions (16) of the roadway (10).

11 Claims, 1 Drawing Sheet

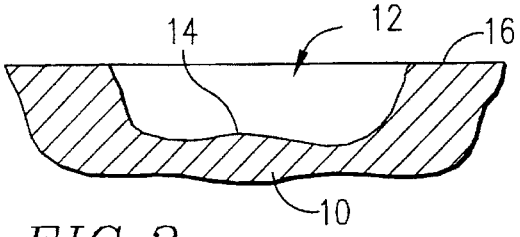
FIG. 3.
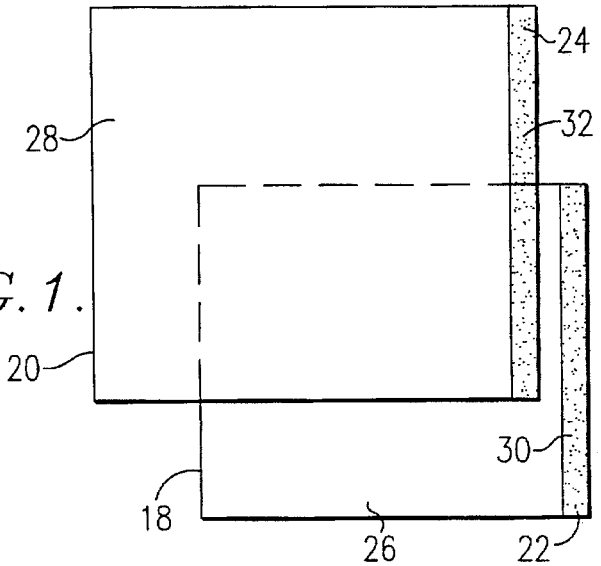
FIG. 1.
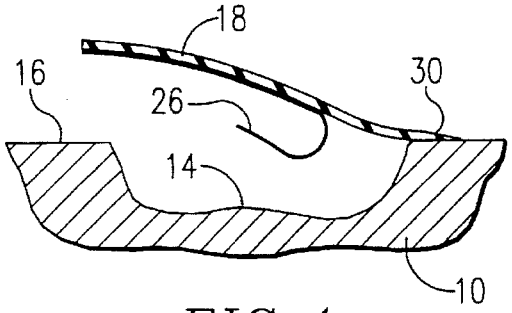
FIG. 4.
FIG. 2.
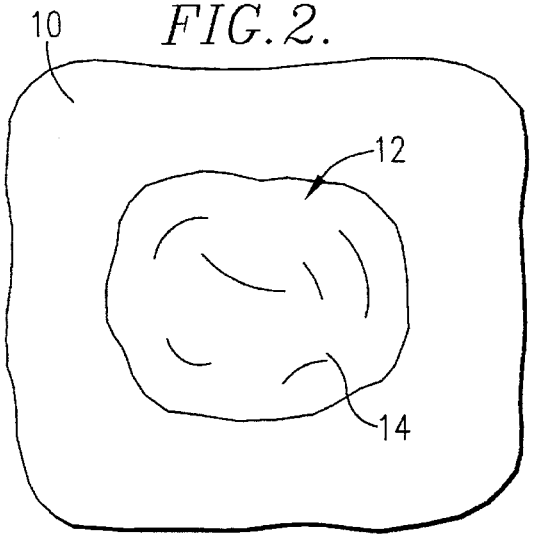
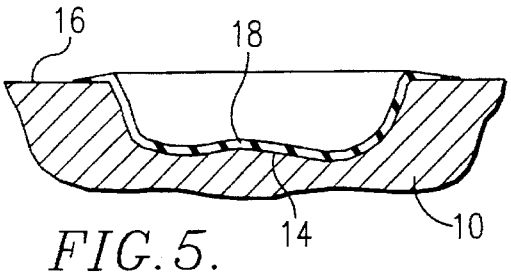
FIG. 5.
FIG. 6.
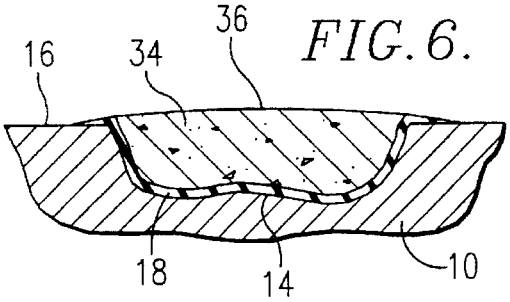
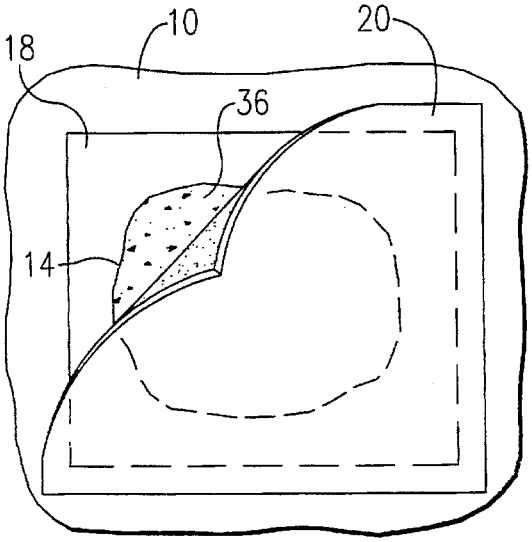
FIG. 8.
FIG. 7.
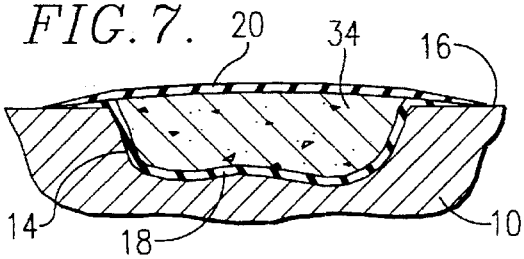

PATCHING SYSTEM AND METHOD FOR REPAIRING ROADWAYS

BACKGROUND OF THE INVENTION

1. Field of the Invention

The present invention is broadly concerned with an improved system and method for patching of damaged roadways by filling "potholes" or other concave damaged regions with an improved fill having water barrier and longevity properties exceeding present day patching systems. More particularly, the invention pertains to such patches wherein a lower asphaltic liner is placed in the damaged region of a roadway in closely conforming relationship to the inner contour thereof followed by asphaltic fill material and a final asphaltic upper top mat covering the fill material and extending substantially over the damaged region to engage adjacent roadway portions.

2. Description of the Prior Art

The repair of "potholes" or other damaged areas in roadways has presented a continuing problem for municipal and highway engineers. Once a pothole is formed, it will continue to expand and erode under vehicular traffic and ambient temperature conditions. Therefore, a patch or repair is essential to prevent virtual destruction of the roadway.

The traditional approach in repairing potholes has been to fill the pothole with an asphaltic patching material. Generally, these repairs are done by road crews who simply fill and pack the pothole with the asphaltic repair material, forming a crown of the patching material. These types of repairs are generally unsatisfactory, and have relatively short services lives, especially on heavily traveled roadways. A prime deficiency with such patching efforts stems from the fact that moisture can readily migrate from the roadway into the patching material, which tends to degrade the patch particularly in cold weather conditions where the patch is subjected to freeze-thaw cycles. Also, normal rainfall will also cause moisture to be taken up by the patching material.

U.S. Pat. No. 5,183,353 describes a pavement repair fill wherein a water-impervious sheet is laid over the fill material as a barrier. In order to attach the sheet, tar is applied over the fill and extended outwardly beyond the peripheral edges of the hole. It is believed that patches in accordance with the '353 patent are deficient in that no provision is made for a water-impervious liner beneath the fill material. As a consequence, the fill can still take up moisture from within the adjacent roadway.

SUMMARY OF THE INVENTION

The present invention overcomes the problems outlined above and provides an improved patch and method for repairing concave damaged regions of a roadway. Broadly speaking, the patch of the invention includes a lower sheet-type asphaltic liner adapted for placement in the damage region in closely conforming relationship to the inner contour thereof, together with fill material (which may be conventional asphaltic patching material) substantially filling the damaged region. The patch is completed by an asphaltic upper top mat covering the fill material and extending substantially over the damaged region, with the top mat adhering to the lower liner.

The liner is advantageously in the form of a flexible and stretchable sheet having a thickness of at least about 1/32 inch and including from about 70–90 percent by weight asphalt and from about 1–10 percent by weight elastomer. The liner should have sufficient flexibility and tack to conform with and adhere to the inner contour of the damaged region, in order to present a substantially water-impervious barrier therein. The preferred top mat is similar to the liner, but preferably should have substantially no elongation properties. Generally, the top mat should also have a thickness of at least about 1/32 inch and should contain from about 75–96 percent by weight asphalt.

In patching procedures, the pothole or other damaged area is cleaned to remove loose rocks and the like, whereupon the liner is placed therein and manually pressed into close conforming relationship with the contour of the pothole. This also causes the liner to substantially adhere to the pothole contour. Next, fill material is placed atop the liner to substantially completely fill the pothole. Finally, a top mat is positioned over the fill material and pressed into adhering contact with the liner. To this end, it is normally desirable to provide a top mat which extends outwardly beyond the outer margin of the underlying liner so that the top mat not only adheres to the liner but also engages and adheres to the adjacent portions of the roadway.

BRIEF DESCRIPTION OF THE DRAWINGS

FIG. 1 is an elevational view of the preferred liner and top mat sheets of the invention, shown with stripable protective films on the tack surfaces thereof;

FIG. 2 is a plan view of a portion of a roadway depicting a pothole therein;

FIG. 3 is a fragmentary vertical section view illustrating the inner contour of the pothole illustrated in FIG. 2;

FIG. 4 is a sectional view depicting the initial placement of the liner in the pothole, showing preliminary adherence of a margin of the liner to the roadway surface, followed by stripping of the protective film;

FIG. 5 is a view similar to that of FIG. 4 but illustrating the liner fully in place and in close, conforming and adhering relationship with the inner contour of the pothole;

FIG. 6 is a sectional view illustrating the next step in the patching method wherein asphaltic fill is placed within the pothole atop the liner;

FIG. 7 is a sectional view depicting the final pothole repair with the top mat positioned over the fill and extending outwardly to adhere with adjacent portions of the liner and the roadway; and FIG. 8 is a top view of the completed patch but with a portion of the top mat pulled back to reveal the construction of the patch.

DETAILED DESCRIPTION OF THE PREFERRED EMBODIMENT

Turning now to the drawings, and particularly FIG. 2, a roadway 10 is shown presenting a damaged region in the form of a concave pothole 12. The pothole 12 is defined by an irregular inner concave surface or contour 14 as well as adjacent regions 16 of undamaged roadway.

The patching system of the invention makes use of a pair of asphaltic sheet-like layers, namely a liner 18 and top mat 20 (see FIG. 1). Both the liner 18 and the top mat 20 include a tacky undersurface 22, 24 which is substantially covered by a protective film 26, 28. It will be observed in FIG. 1 that a short section 30, 32 of the corresponding tacky surfaces 22, 24 are uncovered; in practice, the short sections 30, 32 are also covered with appropriately sized film segments (not shown), and these segments are initially removed during installation in a manner to be described.

The liner should have a thickness of at least about 1/32 inch, and more preferably from about 1/32–1/4 inch; the most preferred liner has a thickness of about 1/16 inch. It is important that the liner have sufficient flexibility and stretchability to allow it to be pressed into closely conforming and adhering relationship with the inner contour 14 of pothole 12. At the same time, the tack surface 22 thereof should have sufficient adherence qualities to cause the liner to adhere to the contour 14. Advantageously, the liner should have a softening point of at least about 150° F.

In preferred forms, the liner should contain from about 70–90 percent by weight asphalt, more preferably from about 78–88 percent by weight asphalt and most preferably about 84 percent by weight thereof. Also, the liner should have from about 1–10 percent by weight elastomer, more preferably about 3–8 percent by weight thereof, and most preferably about 5 percent by weight elastomer. Other optional ingredients for the liner include synthetic resin, process oil and asphalt antistrip compound.

The most preferred liner includes 84 percent by weight AC-10 asphalt; 5 percent by weight Krayton D 1118 elastomer; 2.5 percent by weight Pentalyn H synthetic resin; 7.5 percent by weight process oil; and 1 percent by weight Redicote 82-S antistrip compound. The liner is manufactured by first heating the process oil to 300° F. and placing it in a high shear mixer, whereupon the Pentalyn H is added. Thereafter, 20–40% by volume (most preferably 20%) of the asphalt (preheated to 300° F.) is added to the mixer and the Krayton D 1118 elastomer is then slowly added over a period of at least 15 minutes with continued mixing. This mixture is then subjected to further high shear mixing for a period of at least about 2 hours to ensure homogeneity. At this point the remainder of the asphalt (preheated to 300° F.) is added along with the Redicote 82-S. At this point the entire mixture is again subjected to high shear mixing for a period of at least two hours. In final processing, the temperature of the mixture is reduced by passing it through a chiller (preferably to about 115° F). This causes the mixture to begin to solidify and at this point the mixture is extruded or milled using compression rollers to form a 1/16 inch thick sheet. The last step involves placement of a release film 26 on one surface of the sheet, followed by sprinkling talc on the opposite surface to reduce the tack of that surface.

The AC-10 asphalt (CAS# 8052-42-4) is a conventional material which can be obtained from a variety of commercial sources, e.g. Vance Bros. Inc. of Kansas City, Mo. This material typically has a flash point (C.O.C.) of 6.00° F., a viscosity at 140° F. of 919 poise, a penetration at 77° F. of 98 dmm and a solubility in 1,1,1 trichloroethane of 99.95 percent.

The Krayton D 1118 product is sold by Shell Oil Company of Houston, Tex. and is a styrene-butadiene-styrene block copolymer (CAS# 9003-55-8) also including an antioxidant/stabilizer, talc and hydrated amorphous silica. Additional information on this product can be obtained from a Shell MSDS document no. 2657-07 dated 6-25-93, incorporated by reference herein. Of course, while this particular thermoplastic rubber elastomer is preferred, those skilled in the art will recognize that other elastomers could also be used.

The Pentalyn H product is sold by Hercules Incorporated of Wilmington, Del. and is a pentaerythritol ester of partially hydrogenated wood resin (CAS# 064365-17-9). Further information about this product can be obtained from a Hercules product bulletin dated 6-16-95 which is incorporated by reference herein.

The process oil is also commercialized by Shell Oil Company of Houston, Tex. as Shellflex 4132. It is a mixture of solvent refined, hydrotreated middle distillate (CAS# 64742-46-7) and severely hydrotreated light napthenic distillate (CAS# 64742-53-6). The process oil is added as an extender to the AC-10 asphalt. Further information about the process oil product can be found in a Shell Oil MSDS document no. 10057-06 dated 2-23-93, which is incorporated by reference herein.

The Redicote 82-S product is a proprietary antistripping compound sold by Akzo Chemicals Inc. of Chicago, Ill. Information pertaining to the product may be obtained from an Akzo MSDS document no. 01-057141 dated 8-10-88 and incorporated by reference herein.

The top mat 20 of the invention preferably includes from about 75–96 percent by weight roofing grade asphalt, more preferably from about 85–95 percent by weight thereof, and most preferably about 92.5 percent by weight of this material. The top mat also advantageously includes minor amounts of synthetic resin, process oil and antistripping compound. The softening point of the top mat should be at least about 150° F.

A preferred top mat contains 92.5 percent by weight roofing grade asphalt, 2.0 percent by weight Piccotac 95 resin; 5.0 percent by weight process oil and 0.5 percent by weight Redicote 82-S. In manufacturing procedures, the process oil is first heated to 300° F. and placed in a high shear mixer. The Piccotac 95 product is then added followed by the roofing grade asphalt, with subsequent high shear mixing for about 1 hour. The Redicote 82-S is then added with mixing for about 2 hours. At this point, the mixture is cooled by passing it through a chiller until it begins to solidify (about 150° F.) and is extruded or milled as described above to form a sheet. The sheet should have a thickness of at least 1/32 inch, more preferably from about 1/32–1/4 inch, most preferably about 1/16 inch. The strippable film or release liner 28 is then applied to one surface of the film, and the opposite surface is sprinkled with talc.

The roofing grade asphalt is likewise a well known commercially available product obtainable from a number of sources. Type II roofing grade asphalt is normally used which has a softening point of between 158°–176° F., a flash point of 437° F., penetration units of 6 (32° F.) and 18 (77° F.), a ductility at 77° F. of 3.0 cm and a solubility in trichloroethylene of 99%.

The Piccotac 95 synthetic resin is an aliphatic hydrocarbon resin (CAS# 152698-66-3) and is a hot, molten, viscous liquid at 212°–230° F. The material has a Cleveland open cup flashpoint of 555°, negligible solubility in water at 20° C., a specific gravity of 0.95 and a softening point (R&B) of 91°–97° C., a viscosity at 25° C. of 2.9 stokes, a molecular weight of 1,360 (gel permeation chromatography). Further information pertaining to this product can be found in a Product Data Sheet entitled "PICCOTAC® 95 Resin distributed by Hercules Incorporated of Wilmington, Del., which is incorporated by reference herein.

The Shellflex 4132 process oil and Redicote 82-S antistripping compound are fully described and identified above.

The following table summarizes the important and optional ingredients of the liner and top mat sheets of the invention, giving broad and preferred ranges, and the most preferred amounts. It is to be understood that these ranges and amounts are approximate values.

TABLE

| Ingredient % By Wt. | Broad Range | Preferred Range | Most Preferred Amount |
|---|---|---|---|
| Liner | | | |
| Asphalt | 70–90 | 78–88 | 84.00 |
| Elastomer | 1–10 | 3–8 | 5.00 |
| Synthetic Resin | 0.5–10 | 1–5 | 2.50 |
| Process Oil | 3–15 | 5–10 | 7.50 |
| Asphalt Antistrip | 0.1–4 | 0.5–2.5 | 1.50 |
| Top Mat | | | |
| Asphalt | 75–96 | 85–95 | 92.5 |
| Synthetic Resin | 0.5–10 | 1–7 | 2.0 |
| Process Oil | 1–10 | 3–8 | 5.0 |
| Asphalt Antistrip | 0.1–5 | 0.3–3 | 0.5 |

Attention is again directed to the drawing and particularly FIGS. 3–7 which illustrate the patching method of the invention. After initial clean-out of the pothole 12, the tag end 30 of liner 18 is uncovered by removing the liner segment therefrom, and the end 30 is pressed into contact with the adjacent region 16 of the roadway. Next, the film 26 is manually stripped from the liner (FIG. 4). Thereafter, the liner 18 is manually pressed into close conforming and adhering relationship with pothole contour 14 as best seen in FIG. 5. This is readily accomplished owing to the flexibility and stretchability of the liner 18. The margin of the liner 18 remote from the uncovered tag end 30 is also pressed into engagement with the undamaged region 16 of the roadway. In some cases, it may be advisable to water spray the concave surfaces of the pothole, prior to application and placement of the liner 18.

After the liner 18 is in place, an asphaltic fill material 34 is placed within the pothole and tamped down, to present a slight upper crown 36 as shown in FIG. 6. The fill material 34 can be any conventional or desired fill, such as the asphaltic patching materials now in use for pothole repair.

FIG. 7 illustrates the complete patch wherein the top mat 20 is positioned over the fill 34. Initial placement of the top mat 20 is accomplished in the same manner as liner 18, i.e., the tag end 32 is initially uncovered by removal of the protective film segment and the end 32 is then adhered to the liner 18 and roadway surface. Next, the remainder of the protective film 28 is removed by stripping. The top mat 20 is then placed over the fill material 34 in direct adhering relationship with the upper crown 36 thereof. It will observed in this respect that the top mat 20 is preferably of a size to extend outwardly beyond the outer portions of the liner so as to directly engage both the underlying portions of the liner 18 and the roadway itself (see FIG. 8). In order to ensure the best adherence, the adjoining portions of the top mat 20 and liner 18 are tamped or compressed together. This may be accomplished by means of a roller or simply by foot pressure.

The completed patch of the invention provides a longlasting roadway repair. This longevity is attributable to the fact that the liner 18 and top mat 20 are substantially impervious to water, thereby isolating the inner fill material in a "capsule" which substantially prevents ingress of water into the fill.

I claim:

1. A patch for repairing a concave damaged region of a roadway and comprising:

a lower asphaltic liner adapted for placement in said damaged region in closely conforming relationship to the inner contour thereof, said liner having portions extending outwardly from said damaged region and lying on adjacent portions of said roadway;

fill material atop said liner and substantially filling said damaged region; and an asphaltic upper top mat covering said fill material and extending substantially over said damaged region, said top mat adhering to said liner.

2. The patch of claim 1, said top mat having an outer section extending outwardly beyond said outer portions of said liner and directly engaging said roadway.

3. The patch of claim 1, said liner having sufficient flexibility and tack to adhere to said inner contour and sufficient thickness to present a substantially water-impervious barrier.

4. The patch of claim 1, said liner having a melting point of at least about 150° F.

5. The patch of claim 1, said liner having a thickness of at least about 1/32 inch.

6. The patch of claim 6, said thickness being from about 1/32 to 1/4 inch.

7. The patch of claim 1, said liner comprising from about 70–90% by weight asphalt and from about 1–10% by weight elastomer.

8. The patch of claim 1, said top mat having sufficient tack to adhere to said liner and portions of said roadway adjacent said damaged region.

9. The patch of claim 1, said top mat having essentially no elongation.

10. The patch of claim 1, said top mat having a thickness of at least about 1/32 inch.

11. A method of repairing a concave damaged region of a roadway, comprising the steps of:

placing a lower asphaltic liner within said concave damaged region in closely conforming relationship with the interior contour thereof with portions of said liner extending outwardly from said damaged region and lying atop said roadway, and adhering the liner to said contour;

placing fill material atop said liner and substantially filling said concave damaged region; and positioning a top mat over said fill material and substantially over said damaged region, and adhering said top mat to said liner.

* * * * *